US005653338A

United States Patent [19]

Tani

[11] Patent Number: 5,653,338

[45] Date of Patent: Aug. 5, 1997

[54] COSMETIC EXTRUSION CASE

[75] Inventor: Yoshikazu Tani, Tokyo, Japan

[73] Assignee: Takiwa Corporation, Japan

[21] Appl. No.: 515,962

[22] Filed: Aug. 16, 1995

[30] Foreign Application Priority Data

Aug. 25, 1994 [JP] Japan ..... 6-201097
Aug. 11, 1995 [JP] Japan ..... 7-206167

[51] Int. Cl.[6] ..... B65D 85/72

[52] U.S. Cl. ..... 206/385; 401/71; 401/78; 401/69

[58] Field of Search ..... 206/385, 581; 401/68, 69, 71, 75, 78; 132/318

[56] References Cited

U.S. PATENT DOCUMENTS

| | | | |
|---|---|---|---|
| 2,395,710 | 2/1946 | Anderson | 401/69 |
| 2,506,984 | 5/1950 | Anderson | 401/69 |
| 3,230,960 | 1/1966 | Moore et al. | 206/385 |
| 3,393,036 | 7/1968 | Fuglsang-Madsen | 206/385 |
| 3,511,575 | 5/1970 | Berins | 401/78 |
| 4,180,163 | 12/1979 | Grioni | 206/385 |
| 4,770,556 | 9/1988 | Ackermann et al. | 401/69 |
| 4,813,801 | 3/1989 | Cardia | 206/385 |
| 4,961,663 | 10/1990 | Iwamoto et al. | 401/78 |
| 5,172,993 | 12/1992 | Ackermann et al. | 401/78 |
| 5,348,410 | 9/1994 | Shozi et al. | 401/78 |

*Primary Examiner*—David T. Fidei
*Attorney, Agent, or Firm*—Greer, Burns & Crain, Ltd.

[57] ABSTRACT

A cosmetic extrusion case includes a chuck holding a cosmetic, an intermediate cylinder into which the chuck is inserted, a base cylinder into which the intermediate cylinder is inserted. By forming helical grooves in the inner surfaces of the intermediate cylinder and the base cylinder, respectively, the case has a dual structural extruding mechanism. The helical groove of the intermediate cylinder extends to the open end of the intermediate cylinder to allow a projection of the chuck to easily engage with the helical groove from the open end, thereby smoothly inserting the chuck into the intermediate cylinder. The intermediate cylinder has a thread protrusion at the open end side thereof, the inner diameter Da of which is smaller than the inner diameter D of the crest of the helical groove thereof, and the chuck has an engagement member disposed around a shaft portion thereof, the outer diameter Ds of which is larger than Da and smaller than D, thereby facilitating the insertion of the chuck into the intermediate cylinder and stably holding the chuck fully extruded without sway.

9 Claims, 9 Drawing Sheets

COSMETIC EXTRUSION CASE

BACKGROUND OF THE INVENTION

The present invention relates to an extrusion case for stick-shaped cosmetic, such as lipstick, which is provided with a dual-structural extruding mechanism.

An extrusion case for stick-shaped cosmetic with a dual-structural extruding mechanism is characterized in that the whole size can be miniaturized by reducing the length of the cosmetic extrusion case. Various types of extrusion cases have been proposed. For example, a extrusion case disclosed in Japanese Utility Model Publication No. H4(1992)-33069 comprises, as shown in FIG. 16, a base cylinder 4 consisting of a cylindrical housing and an inner cylinder which is fixed in the cylindrical housing, and a tip cylinder 1 which is fitted into the cylindrical housing to permit rotation relative to the base cylinder 4.

The tip cylinder 1 has an elongated aperture 11 formed in the longitudinal direction, the section of which is non-circular in shape.

A chuck 2 having a non-circular external periphery corresponding to the non-circular section of the an elongated aperture is inserted into the tip cylinder 1 to permit sliding forwards and backwards and not to permit rotation relative to the tip cylinder 1.

The base cylinder 4 is provided with a first helical grooves 5 formed in the inner surface thereof. An intermediate cylinder 6 is inserted into the base cylinder 4 to engage first projections 7 projecting from the outside surface of the intermediate cylinder 6 into the first helical grooves 5 of the base cylinder 4. The intermediate cylinder 6 is provided with second helical grooves 8 formed in the inner surface thereof. The chuck 2 is provided with a shaft portion 9 having second projections 10 projecting from the outer surface thereof. The shaft portion 9 is inserted into the intermediate cylinder 6 to engage the second projections 10 of the shaft portion 9 into the second helical grooves 8.

Further, the second projections 10 are disposed at the rear end of the shaft portion 9 of the chuck 2. The shaft portion 9 has a hemispheric projection 40 formed near the second projections 10. The intermediate cylinder 6 has an annular protrusion 41 formed around the periphery the front end thereof to close the second helical grooves 8. When the chuck 2 is inserted into the intermediate cylinder 6, the second projections 10 and the hemispheric projection 40 have to pass over the annular protrusion 41. Then, when the chuck 2 is extruded fully, the hemispheric projection 40 passes over the protrusion 41 to engage the protrusion 41 between the hemispheric projection 40 and the second projections 10, thereby securely holding the chuck 2.

However, the aforementioned prior art has problems as follows:

a) Since the second helical grooves 8 in the intermediate cylinder 6 are closed by the annular protrusion 41 at the front end thereof, the second projections 10 and the hemispheric projection 40 have to pass over the annular protrusion 41 in order to engage the second projections 10 of the shaft portion 9 of the chuck 2 in the second helical grooves 8. Therefore, the insertion of the chuck 2 into the intermediate cylinder 6 needs great forces;

b) Since nothing guides the intermediate cylinder 6 during the sliding, it is not secured that the intermediate cylinder 6 slides stably; and c) Since it is not secured that the intermediate cylinder 6 slides stably as mentioned above, the chuck 2 is in the shaky condition during moving forward and the cosmetic held by the chuck 2 is thereby loaded so that there is a possibility of braking the cosmetic.

SUMMARY OF THE INVENTION

The present invention is achieved in consideration of the aforementioned problems and permits an intermediate cylinder to slide smoothly in the longitudinal direction without coming off the slotted hole of a tip cylinder upon providing an engagement member disposed around a shaft portion of a chuck, the outer diameter of which is smaller than the inner diameter of the crest of a second helical grooves of the intermediate cylinder, and allowing the engagement member of the chuck to be guided inside of the intermediate cylinder, or by making the sectional configuration of the intermediate cylinder taking the form of the inscribed circle of the regular-polygonal slotted hole of the tip cylinder. It is an object of the present invention to provide a cosmetic extrusion case, which does not allow the shaky condition of the chuck so that the chuck smoothly and stably slides forwards and backwards without coming off the intermediate cylinder and which can be made at low cost, according to the aforementioned structure.

It is another object of the present invention to provide a cosmetic extrusion case, which does not need great force to incorporate the chuck into the intermediate cylinder so that the chuck is easily incorporated into the intermediate cylinder, by providing open ends at the front ends of the second helical grooves of the intermediate cylinder.

It is still another object of the present invention to provide a cosmetic extrusion case, in which there is no possibility that the chuck comes off the intermediate cylinder, by allowing an engaging surface of the engagement member disposed around the shaft portion of the chuck to be in close contact with the rear end face of the protrusion formed at the open end side of the intermediate cylinder.

In order to achieve the above objects, the cosmetic extrusion case of the present invention is structured as follows.

The cosmetic extrusion case comprises a chuck holding a cosmetic, a tip cylinder having a slotted hole into which the chuck is inserted slidably in the longitudinal direction, a base cylinder being rotatably mounted to a base portion of the tip cylinder and having a first helical groove formed in the inner surface thereof, an intermediate cylinder being inserted into the base cylinder and having a first projection engaging to the first helical groove on the outer surface thereof and a second helical groove formed in the inner surface thereof, and a shaft portion rearwardly extending from the chuck and inserted into the intermediate cylinder wherein the shaft portion has a second projection disposed on the outer surface thereof to engage the second projection to the second helical groove of the intermediate cylinder. The intermediate cylinder has an open end of the second helical groove at the front end thereof and a thread protrusion at the open end side having inner diameter smaller than the inner diameter of a crest of the second helical groove. The shaft portion of the chuck has an engagement member having an outer diameter greater than the inner diameter of the thread protrusion and smaller than the inner diameter of the crest of the second helical groove. The engagement member lies in the intermediate cylinder and is capable of engaging with the thread protrusion when the chuck is fully extruded.

Further, the outer diameter of the engagement member is nearly the same as the inner diameter of the crest of the second helical groove.

Furthermore, the engagement member has an engaging surface facing the cosmetic holding side and the engaging surface comes in close contact with a rear end face of the thread protrusion formed at the open end side of the base cylinder.

In addition, the engaging surface of the engagement member lies at the right angle to the axis of the chuck and the rear end face of the thread protrusion lies at the right angle to the axis of the intermediate cylinder.

Further, the engaging surface of the engagement member and the rear end face of the thread protrusion have supplementary angles each other to bring the engaging surface into close contact with the rear end face.

Furthermore, the section of the slotted hole of the tip cylinder into which the chuck is slidably inserted is regular polygonal in shape, the section of the intermediate cylinder except a step portion takes the form of the inscribed circle of the slotted hole, and the intermediate cylinder is slidably incorporated into the slotted hole.

DETAILED DESCRIPTION OF THE PREFERRED EMBODIMENT

Hereinafter, an embodiment of the present invention will be described with reference to FIG. 1 through FIG. 14.

Figure 1:
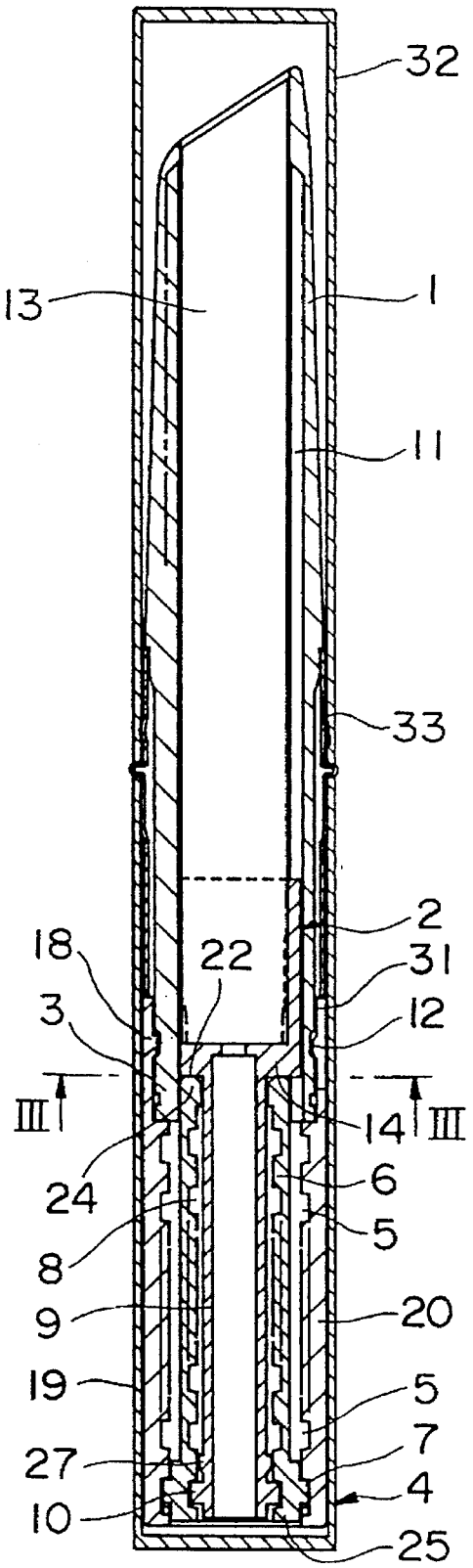
FIG. 1 is a longitudinal sectional view of an embodiment, in the accommodated state, according to the present invention.
Figure 2:
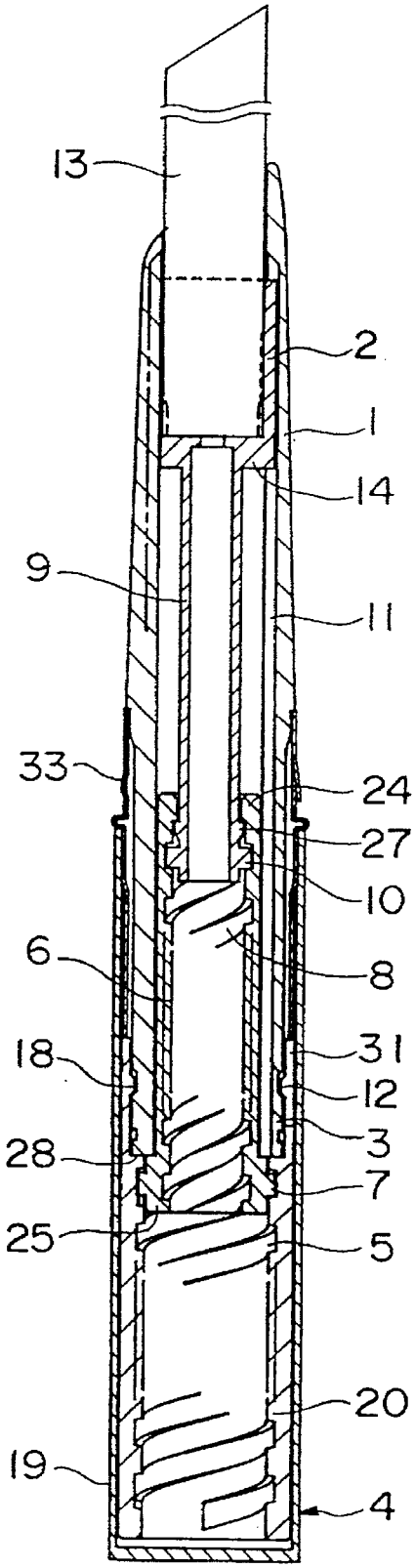
FIG. 2 is a longitudinal sectional view of the embodiment shown in FIG. 1, when the cosmetic is extruded fully.
Figure 3:
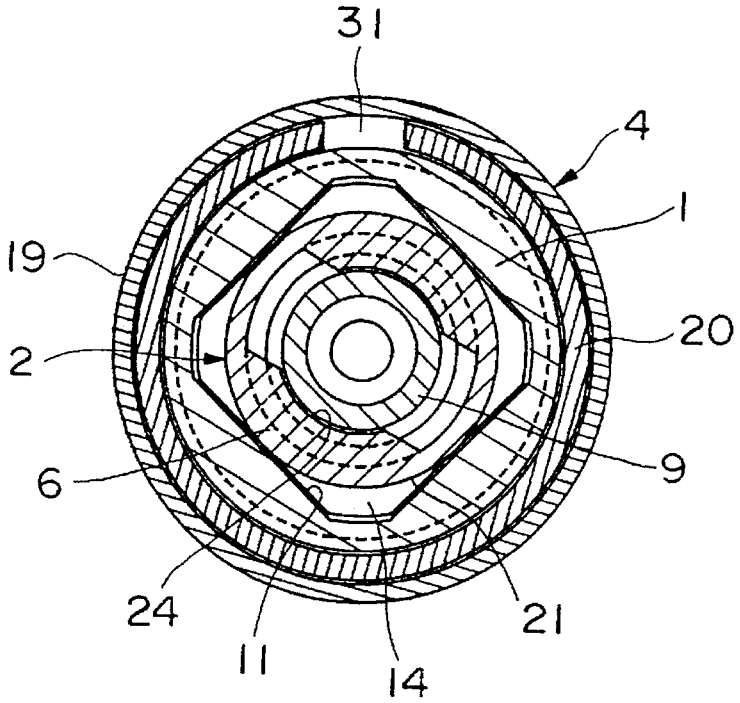
FIG. 3 is a sectional view taken along the line III—III in FIG. 1.

In FIG. 1 through FIG. 3, a tip cylinder 1 is made of synthetic resin and has an elongated aperture, having polygonal section, formed in the longitudinal direction and in the interior thereof as the tip cylinder of the aforementioned prior art. A chuck 2 is provided with a cosmetic holder 14 holding a stick-shaped cosmetic 13 on the top thereof and having a polygonal section to be fitted in the aforementioned polygonal elongated aperture. The chuck 2 is slidably inserted into the polygonal elongated aperture.

In this embodiment, the polygonal section of the elongated aperture formed in the tip cylinder 1 is substantially square in shape. It should be noted that the polygonal section may be not only square as shown in this embodiment but also regular pentagonal, regular hexagonal, regular octagonal, or the like in shape.

The external periphery of the tip cylinder 1 has a substantially circular configuration. The tip cylinder 1 has an annular step (an annular grooves in this embodiment) 12 formed on the outer surface of a base portion 3 thereof. The base portion 3 is inserted into the base cylinder 4 to engage the annular step 12 to an annular step (an annular protrusion in this embodiment) 18 formed on the inner surface of the base cylinder 4. Therefore, the tip cylinder 1 is inserted into the base cylinder 4, allowing rotation relative to each other and not allowing coming off each other. The base cylinder 4 comprises an inner cylinder 20, which is made of synthetic resin and is provided with first helical grooves 5 formed in the inner surface thereof and a slit 31 formed at the front end thereof, and a metallic cylindrical housing 19 with a bottom. The base cylinder 4 is formed by inserting the inner cylinder 20 into the cylindrical housing 19 and fixing the inner cylinder 20 inside the cylindrical housing 19. The metal used to make the cylindrical housing 19 is preferably light metal such as aluminum.

The tip cylinder 1 is covered by a metallic cap 32 when the cosmetic is accommodated as shown in FIG. 1. The cap 32 can be easily removed or put because of the spring force of a cylindrical coupling 33 which is fixed to the inner surface of the top of the cylindrical housing 19.

The chuck 2 has the cosmetic holder 14 holding the cosmetic 13 on the top thereof as shown in FIG. 4 through FIG. 7 in detail. The external periphery of the cosmetic holder 14 is polygonal in shape corresponding to the polygonal shape of the elongated aperture formed inside the tip cylinder 1. In this embodiment, the external periphery of the cosmetic holder 14 is substantially square in shape. The inside of the cosmetic holder 14 is circular in shape corresponding to the configuration of the section of the cosmetic. The cosmetic holder 14 has four clicks 16 by forming four slits 15 in the longitudinal direction.

According to the above mentioned structure, the four clicks 16 can elastically and strongly hold the stick-shaped cosmetic 13, cooperating with projections 17 formed on the inner surfaces thereof in the longitudinal direction. The inside of the cosmetic holder 14 may be not only circular as shown in this embodiment but also oval, polygonal or the like in shape corresponding to the configuration of the section of the cosmetic. The chuck 2 has a shaft portion 9 extending from the cosmetic holder 14.

An intermediate cylinder 6 as shown in detail in FIG. 8 through FIG. 11 is inserted inside the base cylinder 4. As clearly shown in FIG. 3, the section of the intermediate cylinder 6 takes the form of the inscribed circle of the polygonal (in this embodiment, square) elongated aperture of the tip cylinder 1. Therefore, the intermediate cylinder 6 can stably slide forwards and backwards since the outer surface 21 of the intermediate cylinder 6 does not come off the polygonal elongated aperture of the tip cylinder 1.

As shown in FIG. 8 through FIG. 11, the intermediate cylinder 6 has second helical grooves 8 formed in the inner surface thereof with the same pitch as the first helical grooves 5 formed in the base cylinder 4. The second helical grooves 8 are led to open ends 8*a* at the front end 22 of the intermediate cylinder 6. It is preferable that the second helical grooves 8 are formed with the same pitch as the first helical grooves 5. It is also possible depending on the situation to make the pitch of the first helical grooves 5 different from that of the second helical grooves 8.

Figure 11:
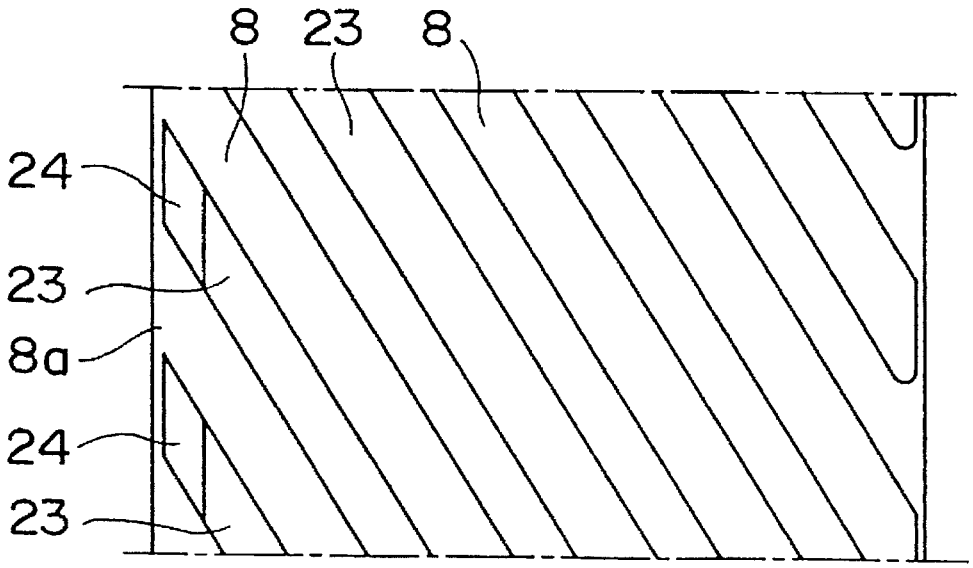
FIG. 11 is a development of second helical grooves of the intermediate cylinder.

The intermediate cylinder 6 is provided with the open ends 8*a* of the second helical grooves 8 and thread protrusions 24 having a diameter smaller than the inner diameter of crests 23 of the second helical grooves 8 at the front end 22 thereof. FIG. 11 shows a development of the intermediate cylinder 6 with the second helical grooves 8, the crests 23 of the second helical grooves 8, and the thread protrusions 24. Further, the intermediate cylinder 6 is provided with an annular step portion 25 at the rear end thereof and a pair of first projections 7 projecting from the outer surface of the annular step portion 25. The first projections 7 are engaged to the first helical grooves 5. In the accommodated state as shown in FIG. 1, the intermediate cylinder 6 is assembled so that the front end 22 is in contact with the cosmetic holder 14 of the chuck 2.

Figure 4:
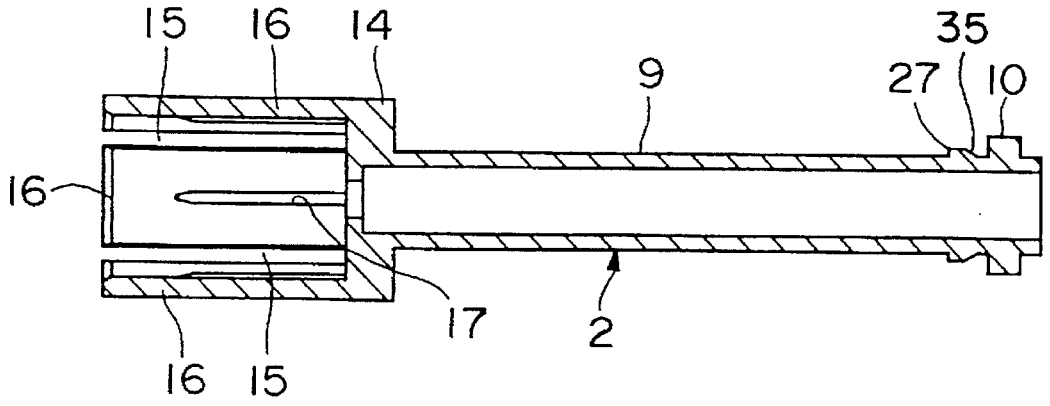
FIG. 4 is a longitudinal sectional view of a chuck used in the embodiment taken along the line IV—IV in FIG. 5.
Figure 5:
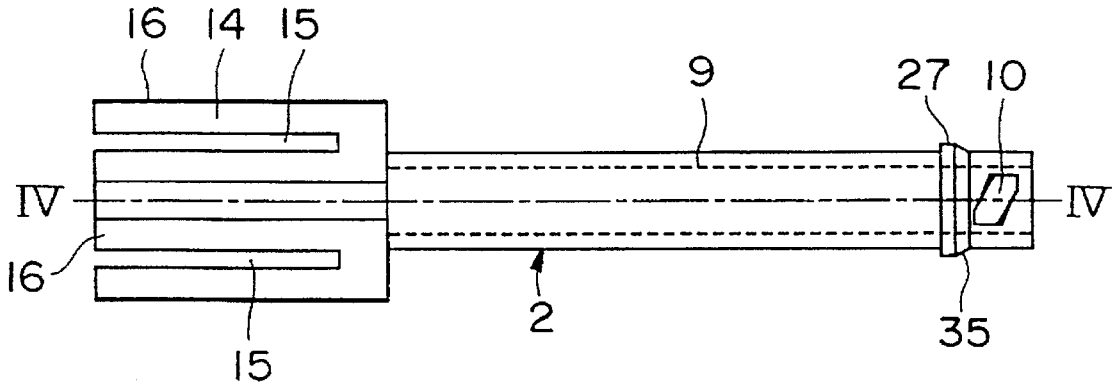
FIG. 5 is a side view of the chuck used in the embodiment.
Figure 6:
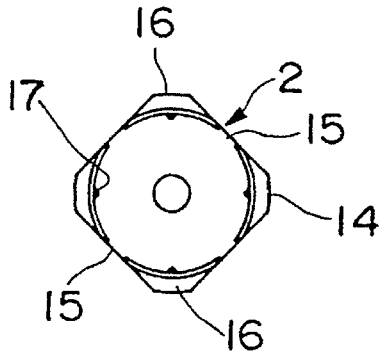
FIG. 6 is a left side view of the chuck shown in FIG. 5.
Figure 7:
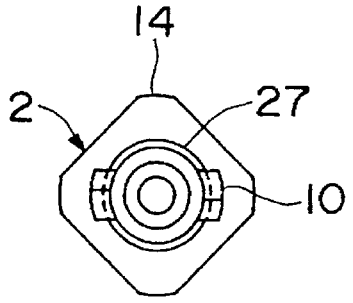
FIG. 7 is a right side view of the chuck shown in FIG. 5.
Figure 8:
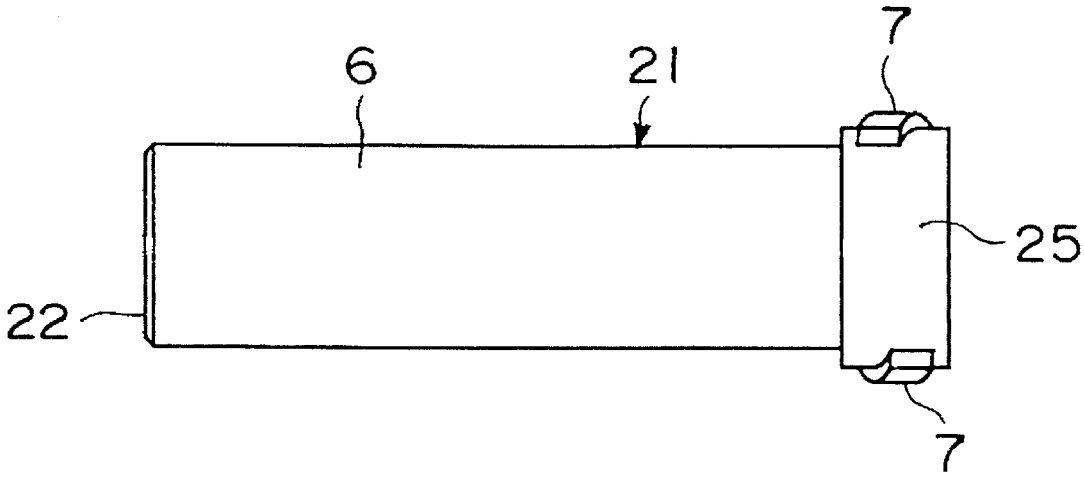
FIG. 8 is a side view of an intermediate cylinder used in the embodiment.
Figure 9:
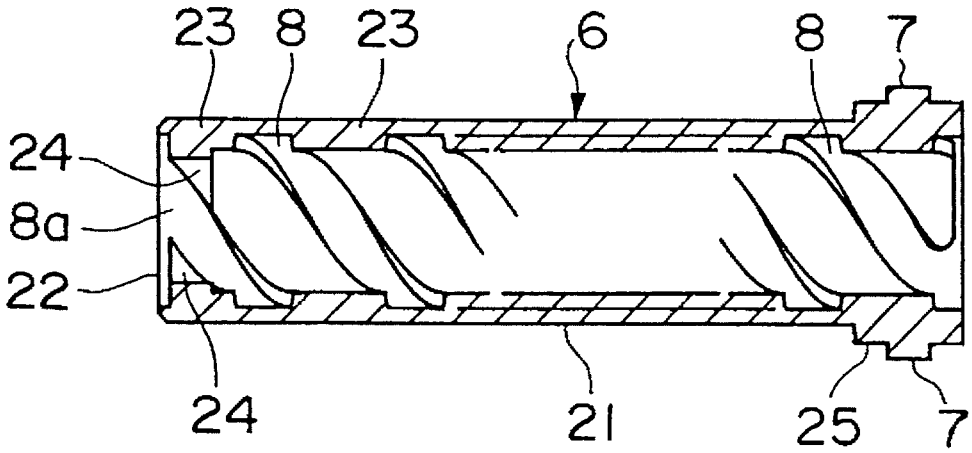
FIG. 9 is a longitudinal sectional view of the intermediate cylinder taken along the line IX—IX in FIG. 10.
Figure 10:
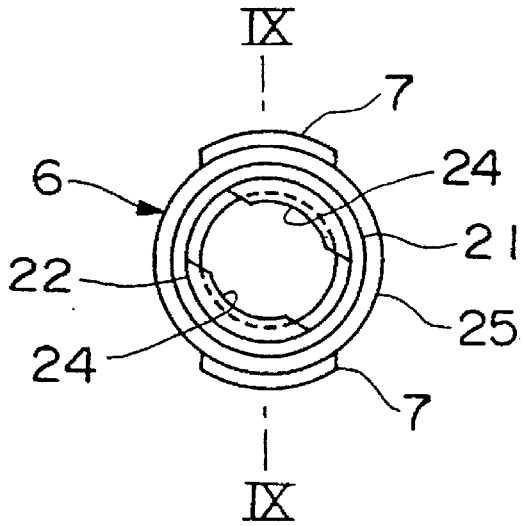
FIG. 10 is a left side view of the intermediate cylinder shown in FIG. 8.

As apparent from the views in FIG. 4 and FIG. 5, the shaft portion 9 extending from the cosmetic holder 14 of the chuck 2 is provided with a pair of second projections 10 at the rear end thereof. The second projections 10 are engaged to the second helical grooves 8 formed in the inner surface of the intermediate cylinder 6. The shaft portion 9 is further provided with an annular engagement member 27 having a diameter smaller than that of the second projections 10, which is disposed a little to the cosmetic holder 14 side than the second projections 10. The engagement member 27 has a slope 35 at the rear end side of the shaft portion 9. It should be noted that the engagement member 27 may be annular as shown in this embodiment or comprise a plurality of pieces disposed around the periphery of the shaft portion 9.

Figure 12:
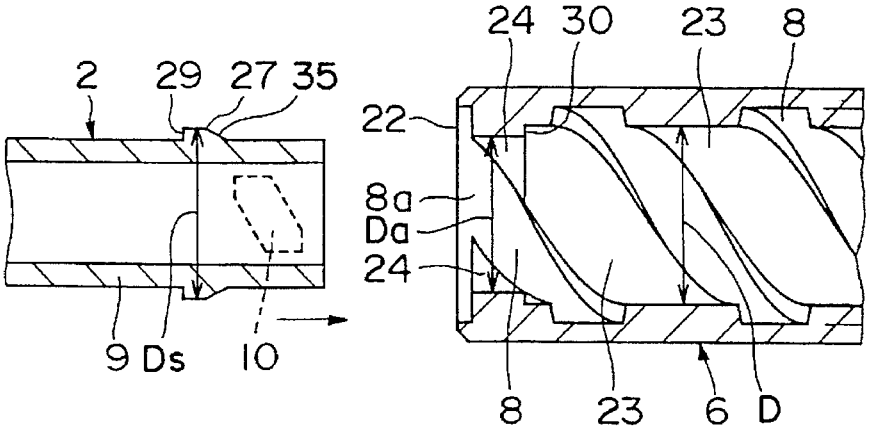
FIG. 12 is a sectional view of a chuck and the intermediate cylinder just before the chuck is inserted into the intermediate cylinder.
Figure 13:
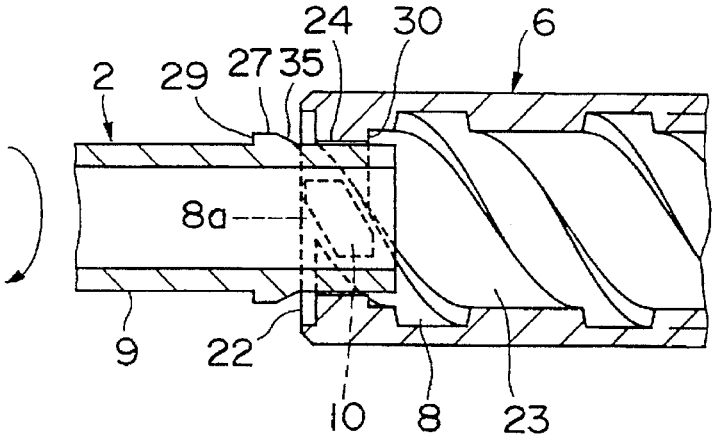
FIG. 13 is a sectional view of the chuck and the intermediate cylinder just after the chuck is inserted into the intermediate cylinder.
Figure 14:
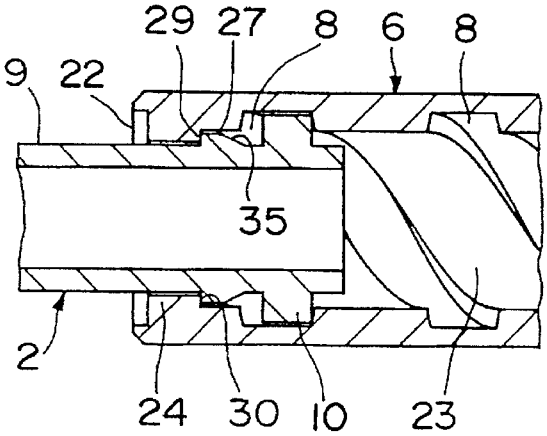
FIG. 14 is a sectional view of the chuck and the intermediate cylinder after the insertion of the chuck into the intermediate cylinder is completed.

As apparent from the views in FIG. 12 through FIG. 14, the annular engagement member 27 has the outer diameter Ds larger than the inner diameter Da of the thread protrusions 24 and slightly smaller than the inner diameter D of the crests 23 of the second helical grooves 8. That is, $Da<Ds<D$.

To incorporate the chuck 2 into the intermediate cylinder 6, the shaft portion 9 of the chuck 2 is inserted into the intermediate cylinder 6 by bringing the shaft portion 9 close to the intermediate cylinder 6 as shown in FIG. 12 to arrange the second projections 10 to the open ends 8*a* of the second helical grooves 8 as shown in FIG. 13 to engage them. The shaft portion 9 is then threaded into the intermediate cylinder 6 by rotating the shaft portion 9 relative to the intermediate cylinder 6 from the state shown in FIG. 13. In the middle of the insertion of the shaft portion 9 into the intermediate cylinder 6 by rotating the shaft portion 9, the thread protrusions 24 comes in contact with the slope 35 of the engagement member 27. From this state, as the shaft portion 9 is further inserted into the intermediate cylinder 6 by the rotation, the engagement member 27 passes over the thread protrusions 24 through the slope 35 so that the engagement member 27 is in roughly contact with the crests 23 of the second helical grooves 8 as shown in FIG. 14.

As the base cylinder 4 is rotated relative to the tip cylinder 1 in the direction of accommodating the chuck 2, the second helical grooves 8 are also rotated. Since the second projections 10 are engaged to the second helical grooves 8, the rotation of the second helical grooves 8 moves the chuck 2 rearwardly (in FIG. 14, to the right side) to accommodate the shaft portion 9 of the chuck 2 in the intermediate cylinder 6. As the base cylinder 4 is further rotated relative to the tip cylinder 1, the rotation of the intermediate cylinder 6 stops and the intermediate cylinder 6 moves inside the base cylinder 4 with the chuck 2 since the first projections 7 projecting from the outer surface of the intermediate cylinder 6 are engaged to the first helical grooves 5. Finally, they become in the accommodated state as shown in FIG. 1.

To extrude the chuck 2, the cap 32 is removed in the state shown in FIG. 1, the base cylinder 4 is then rotated so as to rotate the first helical grooves 5. Since the intermediate cylinder 6 is engaged to the first helical grooves 5, the intermediate cylinder 6 is guided by the polygonal elongated aperture of the tip cylinder 1 to slide forward with the chuck 2 in the longitudinal direction without coming off the elongated aperture. The step portion 25 comes in contact with the rear end face 28 of the tip cylinder 1 so as to stop the forward movement of the intermediate cylinder 6. Then, the intermediate cylinder 6 starts to rotate to move the chuck 2 forward in the polygonal elongated aperture of the tip cylinder 1. The forward movement of the chuck 2 is stopped when the chuck 2 is in the fully extruded state as shown in FIG. 2.

At this point, since the outer diameter Ds of the engagement member 27 is nearly the same of the inner diameter D of the crests 23 of the second helical grooves 8, the engagement portion 27 is guided to move by the crests 23 of the second helical grooves 8, the shaft portion 9 of the chuck 2 can stably move in the intermediate cylinder without sway.

The engagement member 27 has an engaging surface 29 facing the cosmetic holder 14 which lies at right angle to the axis of the shaft portion 9 of the chuck 2. The thread protrusions 24 of the intermediate cylinder 6 have rear surfaces 30 which lie at right angle to the axis of the intermediate cylinder 6. Therefore, the engaging surface 29 and the rear surfaces 30 can be in close contact with each other when the chuck 2 is in the fully extruded state, thereby stably holding the chuck 2 without sway. In addition, the chuck 2 is securely prevented from coming off the intermediate cylinder 6.

Figure 15:
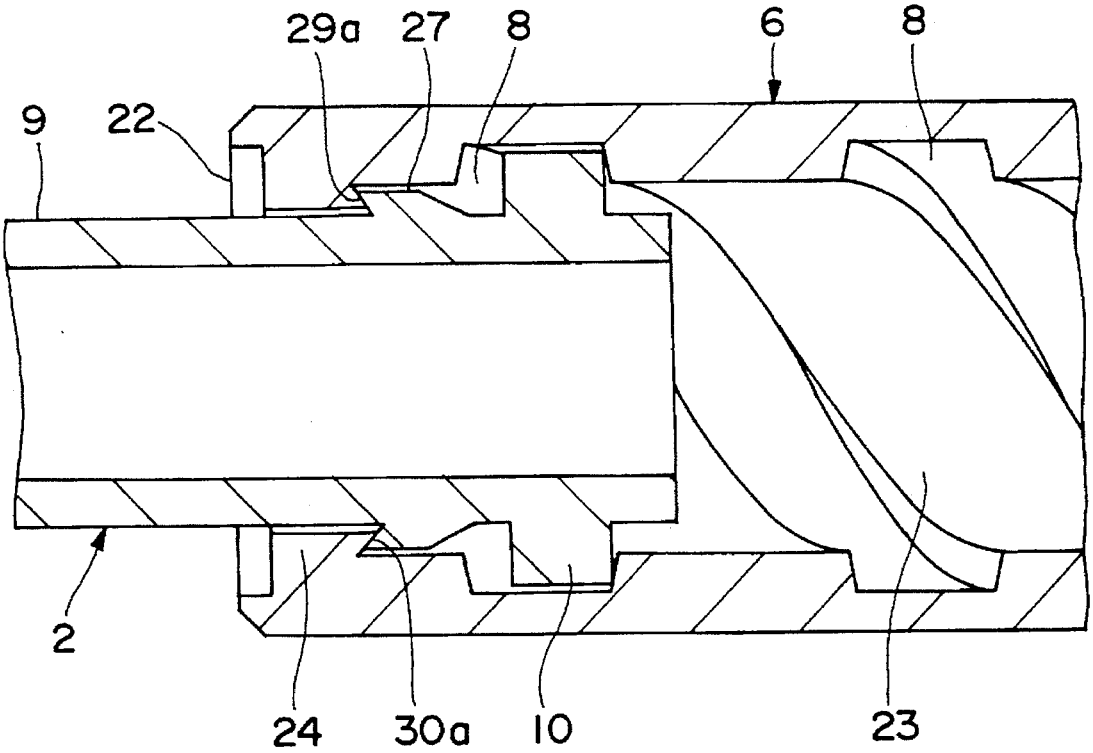
FIG. 15 is a sectional view of a chuck and an intermediate cylinder of another embodiment after the insertion of the chuck into the intermediate cylinder is completed.
Figure 16:
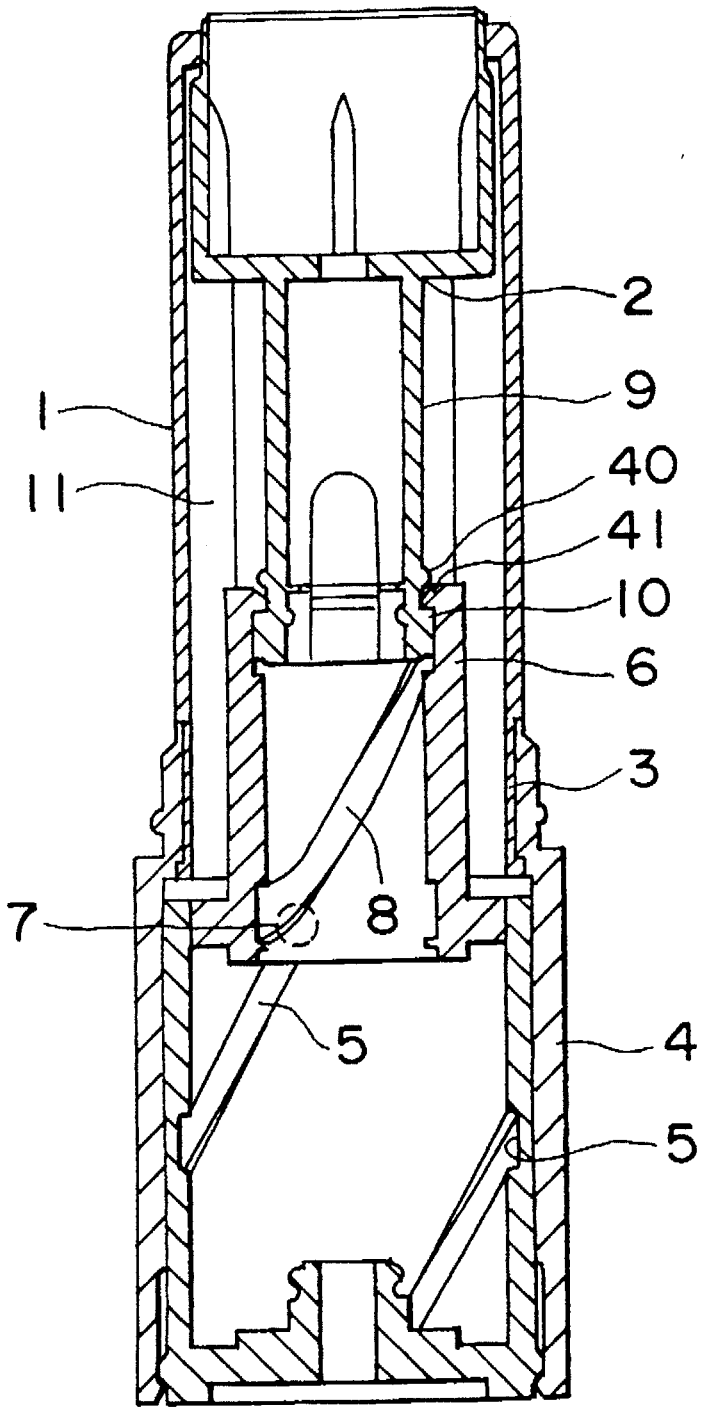
FIG. 16 (PRIOR ART)
FIG. 16 is a longitudinal sectional view of a conventional cosmetic extrusion case.

As shown in FIG. 15, the rear surfaces 30*a* of the intermediate cylinder 6 and the engaging surface 29*a* of the chuck 2 are set to have supplementary angles each other to bring the engaging surface 29*a* into close contact with the rear surfaces 30*a*.

In this structure, the contact area between the engaging surface 29*a* and the rear surfaces 30*a* is increased, thereby further stably holding the chuck 2 and still further securely preventing the chuck 2 from coming off the intermediate cylinder 6.

As apparent from the above description, according to the present invention, a) Since the chuck 2 can be easily incorporated into the intermediate cylinder 6 by inserting the shaft portion 9 of the chuck 2 into the intermediate cylinder 6 from the open ends 8*a* of the second helical grooves 8, engaging the second projections 10 of the shaft portion 9 to the second helical grooves 8, and rotating the shaft portion 9 and the intermediate cylinder 6 relative to each other, it does not need great force to incorporate the shaft portion 9 disposed at the rear end of the chuck 2 to the second helical grooves 8 formed in the intermediate cylinder 6;

b) Since the shaft portion 9 of the chuck 2 has the engagement member 27 having the outer diameter Ds smaller than the inner diameter D of the crests of the second helical grooves 8 of the intermediate cylinder 6, the engagement member 27 of the chuck 2 is guided by the crests in the intermediate cylinder 6, thereby allowing the stable extruding operation of the cosmetic extrusion case, and more particularly, when the outer diameter Ds of the engagement member 27 is nearly the same of the inner diameter D of the second helical grooves 8, allowing the still further stable extruding operation of the cosmetic extrusion case;

c) Since the outer diameter Ds of the engagement member 27 is greater than the inner diameter Da of the thread protrusions 24 disposed at the open ends 8*a* of the intermediate cylinder 6, the engagement member 27 of the chuck 2 is stopped by coming in contact with the rear surfaces 30 of the thread protrusions 24 when the chuck is fully extruded so that there is no possibility that the chuck 2 comes off the intermediate cylinder 6;

d) Since the engaging surface 29 of the engagement member 27 and the rear surfaces 30 of the thread protrusions 24 can compose a close contact between them, the engaging surface 29 of the engagement member 27 comes in close contact with the rear surfaces 30 of the thread protrusions 24 when the chuck 2 is fully extruded so there is no possibility that the chuck 2 comes off the intermediate cylinder 6;

e) Since the section of the intermediate cylinder 6 takes the form of the inscribed circle of the polygonal elongated aperture of the tip cylinder 1, the intermediate cylinder 6 smoothly slides in the longitudinal direction in the elongated aperture of the tip cylinder 1 without coming off, so that the sliding of the intermediate cylinder 6 is smoothly performed without shake and sway when the chuck 2 moves forwards and backwards. Therefore, the load applied to the cosmetic is reduced so that there is no possibility of braking the cosmetic; and f) since the intermediate cylinder 6 can slides in the polygonal elongated aperture of the tip cylinder 1 without coming off, the stable sliding of the intermediate cylinder 6 in the forward and backward directions is secured.

The present invention may be embodied in various forms without departing from the spirit of essential characteristics thereof. Therefore, the above embodiment is illustrative and not restrictive. The scope of the present invention is defined by the appended claims rather than by the description preceding them. Further, various changes and modifications belonging to the equivalence of the claims are within the scope of the present invention.

What is claimed is:

1. A cosmetic extrusion case comprising:

a chuck (2) holding a cosmetic (13);

a tip cylinder (1) having an elongated aperture (11) into which said chuck (2) is inserted slidably in the longitudinal direction;

a base cylinder (4) rotatably mounted to a base portion (3) of said tip cylinder (1), said base cylinder (4) having a first helical groove (5) formed in the inner surface thereof;

an intermediate cylinder (6) inserted into said base cylinder (4), said intermediate cylinder (6) having a first projection (7) engaging to said first helical groove (5) on the outer surface thereof and a second helical groove (8) formed in the inner surface thereof; and a shaft portion (9) rearwardly extending from said chuck (2) and inserted into said intermediate cylinder (6), said shaft portion (9) having a second projection (10) disposed on the outer surface thereof to engage said second projection (10) to said second helical groove (8) of said intermediate cylinder (6);

said intermediate cylinder (6) having an open end (8*a*) of said second helical groove (8) at the front end thereof and a thread protrusion (24), disposed at said open end (8*a*) side, having an inner diameter (Da) smaller than the inner diameter (D) of a crest (23) of said second helical groove (8), said shaft portion (9) of said chuck (2) having an engagement member (27) having an outer diameter (Ds) greater than the inner diameter (Da) of said thread protrusion (24) and smaller than the inner diameter (D) of the crest (23) of said second helical groove (8), said engagement member (27) lying in said intermediate cylinder (6) and being capable of engaging with said thread protrusion (24) when said chuck (2) is fully extruded.

2. A cosmetic extrusion case as claimed in claim 1, wherein the outer diameter (Ds) of said engagement member (27) is nearly the same as the inner diameter (D) of said crest (23) of said second helical groove (8).

3. A cosmetic extrusion case as claimed in claim 1, wherein said engagement member (27) has an engaging surface (29) facing said cosmetic (13) holding side, said engaging surface (29) coming in close contact with a rear end face (30) of said thread protrusion (24) formed at said open end (8*a*) side of said base cylinder (6).

4. A cosmetic extrusion case as claimed in claim 3, wherein said engaging surface (29) of said engagement member (27) lies at the right angle to the axis of said chuck (2) and said rear end face (30) of said thread protrusion (24) lies at the right angle to the axis of said intermediate cylinder (6).

5. A cosmetic extrusion case as claimed in claim 3, wherein said engaging surface (29) of said engagement member (22) and said rear end face (30) of said thread protrusion (24) have supplementary angles each other to bring said engaging surface (29) into close contact with said rear end face (30).

6. A cosmetic extrusion case as claimed in claim 1, wherein the section of said elongated aperture (11) of said tip cylinder (1) into which said chuck (2) is slidably inserted is regular polygonal in shape, the section of said intermediate cylinder (6) except a step portion (25) takes the form of the inscribed circle of said elongated aperture (11), and said intermediate cylinder (6) is slidably incorporated into said elongated aperture (11).

7. A cosmetic extrusion case as claimed in claim 2, wherein said engagement member (27) has an engaging surface (29) facing said cosmetic (13) holding side, said engaging surface (29) coming in close contact with a rear end face (30) of said thread protrusion (24) formed at said open end (8*a*) side of said base cylinder (6).

8. A cosmetic extrusion case as claimed in claim 7 wherein said engaging surface (29) of said engagement member (27) lies at the right angle to the axis of said chuck (2) and said rear end face (30) of said thread protrusion (24) lies at the right angle to the axis of said intermediate cylinder (6).

9. A cosmetic extrusion case as claimed in claim 7, wherein said engaging surface (29) of said engagement member (22) and said rear end face (30) of said thread protrusion (24) have supplementary angles each other to bring said engaging surface (29) into close contact with said rear end face (30).

* * * * *

UNITED STATES PATENT AND TRADEMARK OFFICE

CERTIFICATE OF CORRECTION

PATENT NO. : 5,653,338
DATED : Aug. 5, 1997
INVENTOR(S) : Yoshikazu Tani

It is certified that error appears in the above-indentified patent and that said Letters Patent is hereby corrected as shown below:

On the Title Page:

Item: 73] Assignee:" delete "Takiwa" and insert --Tokiwa-- therefor.

On Column 1, line 22, delete "the an elongated" and insert --the elongated-- therefor.

Signed and Sealed this
Eleventh Day of August 1998

Bruce Lehman

*Attest:*

BRUCE LEHMAN

*Attesting Officer*

*Commissioner of Patents and Trademarks*